US009599333B2

(12) United States Patent
Buzinski et al.

(10) Patent No.: US 9,599,333 B2
(45) Date of Patent: Mar. 21, 2017

(54) BURNER RETRACTION SYSTEM

(71) Applicant: AIR PRODUCTS AND CHEMICALS, INC., Allentown, PA (US)

(72) Inventors: Michael David Buzinski, Slatington, PA (US); Reed Jacob Hendershot, Orefield, PA (US); Shailesh Pradeep Gangoli, Easton, PA (US); Larry Saul Zelson, Macungie, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 591 days.

(21) Appl. No.: 14/075,447

(22) Filed: Nov. 8, 2013

(65) Prior Publication Data

US 2015/0132704 A1 May 14, 2015

(51) Int. Cl.
*F23C 5/02* (2006.01)

(52) U.S. Cl.
CPC ..... *F23C 5/02* (2013.01)

(58) Field of Classification Search
CPC ..... F23C 5/02
USPC ..... 431/189
See application file for complete search history.

(56) References Cited

U.S. PATENT DOCUMENTS 2,685,919 A 8/1954 Plass et al.
2,924,269 A * 2/1960 Genovese ..... F23C 5/02 122/6.5
3,129,930 A 4/1964 Labat-Camy
3,163,388 A 12/1964 Arnaud
3,169,571 A 2/1965 Madsen
3,258,053 A 6/1966 Schuss
3,376,978 A * 4/1968 Hultsch ..... B04B 11/00 210/375
3,989,033 A * 11/1976 Halpern ..... A61B 10/04 600/567
4,302,179 A 11/1981 Pont
4,526,531 A 7/1985 Kai
4,997,475 A 3/1991 Feuillerat

FOREIGN PATENT DOCUMENTS

DE 2261471 A1 6/1973
FR 2648896 A1 12/1990
GB 1231684 A 5/1971

* cited by examiner

*Primary Examiner* — Steven B McAllister
*Assistant Examiner* — Rabeeul Zuberi
(74) *Attorney, Agent, or Firm* — Larry S. Zelson

(57) ABSTRACT

A burner retraction system includes a mounting assembly having a mounting sleeve, an insertion assembly having a tubular sleeve including an insertion portion sized and shaped for insertion into the mounting sleeve and an opening therethrough, a pivot rod rigidly mounted to and extending rearwardly from the mounting plate, and a pivot assembly rigidly mounted to the insertion sleeve and including a pivot tube surrounding and coaxially rotatable about the pivot rod, one of the pivot rod and the pivot tube having a slot including a straight axially extending portion and an angled portion extending rearwardly from the straight portion at an angle θ, and a stop pin slidably inserted into the slot in the one of the pivot rod and the pivot tube, the stop pin being secured to the other of the pivot rod and the pivot tube.

18 Claims, 9 Drawing Sheets

BURNER RETRACTION SYSTEM

BACKGROUND

This application relates to a retraction system for a burner and an integrated burner with retraction system.

A burner installed in a furnace must sometimes be removed, for example, when the process requirements change, or when the burner needs maintenance or replacement. However, burners are often heavy and cumbersome, and there is often limited space around the furnace into which a burner may be retracted. Therefore, it may be difficult for personnel to remove and support a burner without potentially damaging the burner and/or the burner block, and also without injury. Further, once a burner has been removed, there is often no good place to set the burner down so that it will be out of the way from ancillary damage. Lastly, there is little space to maneuver and handle the burner once it has been retracted from the furnace.

An object of the present invention is to simplify the process of burner removal and installation, to make the process more safe for personnel, and to enable burner retraction in the limited space available surrounding a furnace.

SUMMARY

A retraction system is described herein that enables retraction of an entire burner body or a portion thereof from a furnace. The system functions within a small space, as is frequently required. The system retracts a burner from a burner hole in a furnace and rotates the burner out of the installation line of the burner hole in a controlled manner so that the burner hole can be plugged, for example, to prevent fluids escaping from the furnace or so that maintenance can be performed on the burner and burner block. The system causes the burner to rotate out of the installation line in a deliberate manner so that it is not accidently rotated nor rotated with such speed that shear stresses created by the cantilevered weight of the burner are overly high for the burner design.

Once the burner is rotated and held in the rotated position, maintenance can be performed on the burner and/or portions of the burner can be modified or replaced in a convenient manner. Also, although the system described herein has immediate applications for burner removal and maintenance, it is envisioned that the retraction system described herein could be used for controlled retraction and rotation out of the way for many other types of equipment as well.

The retraction system can be actuated either manually or through an automated means to retract an entire burner or a portion thereof. For example, the burner retraction system could also be used to automatically remove a burner when there is a loss of flame either by indication of a flame sensor or some other means, or when there is loss of the burner cooling or other indication that the burner needs to be protected from overheating.

In one embodiment, a burner retraction system includes a mounting assembly, an insertion assembly, a pivot rod, a pivot tube, and a stop pin. The mounting assembly has a mounting plate and a mounting sleeve extending rearwardly from the mounting plate, the mounting sleeve having an axis. The insertion assembly has a tubular sleeve including an insertion portion sized and shaped for insertion into the mounting sleeve of the mounting assembly, the tubular sleeve including an opening therethrough. The tubular sleeve can be of any cross-sectional shape, including but not limited to generally circular and generally rectangular. The pivot rod is rigidly mounted to and extends rearwardly from the mounting plate, the pivot rod having an axis. The pivot assembly is rigidly mounted to the insertion sleeve and includes a pivot tube surrounding and coaxially rotatable about the pivot rod. One of the pivot rod and the pivot tube has a slot including a straight portion extending in the axial direction of the pivot tube, an angled portion extending rearwardly from the straight portion at an angle θ with respect to the axial direction of the pivot tube, and a stop end terminating the angled portion. The stop pin is slidably inserted into the slot in the one of the pivot rod and the pivot tube, the stop pin being secured to the other of the pivot rod and the pivot tube, such that when the insertion assembly is moved rearwardly with respect to the mounting assembly, the insertion portion of the insertion assembly is first retracted straight back from the mounting assembly as the stop pin slides in the straight portion of the slot, and the insertion assembly is then guided to rotate about the pivot rod away from the axis of the mounting assembly as the stop pin slides in the angled portion of the slot, until the stop end of the slot comes into contact with the stop pin.

In one aspect, the pivot tube includes the slot and the stop pin is secured to the pivot rod. In an alternative aspect, the pivot rod includes the slot and the stop pin is secured to the pivot tube.

In one aspect, the insertion assembly is a burner body and the tubular sleeve forms an outer wall of a burner. In another aspect, the insertion assembly is configured to receive and support at least a portion of burner mounted within the tubular sleeve. In yet another aspect, the mounting assembly is a burner body and the mounting sleeve forms an outer wall of a burner, and the insertion assembly is a portion of the burner and the tubular sleeve forms an inner conduit within the burner.

In a further aspect, the mounting assembly further includes a collar protruding radially outward from a rear end of the mounting sleeve, the insertion assembly further including an external portion of the support sleeve extending rearwardly from the insertion portion of the tubular sleeve and a collar protruding radially outward from the tubular sleeve at a junction between the insertion portion and the external portion, and the mounting assembly collar and the insertion assembly collar are configured to be adjacent to one another when the insertion portion of the tubular sleeve is fully inserted into the mounting sleeve.

In a further aspect, the pivot assembly further includes a mounting bracket rigidly affixed to the pivot tube and removably mounted to the tubular sleeve.

In a further aspect, the mounting sleeve includes an inner bevel and the insertion portion of the tubular sleeve includes an outer bevel to facilitate alignment of the tubular sleeve with the mounting sleeve during insertion of the insertion portion into the mounting sleeve.

In a further aspect, an annular bushing is positioned between the pivot rod and the pivot tube at each end of the pivot tube.

In a further aspect, an annular bushing surrounds the stop pin to facilitate sliding of the stop pin with the slot of the pivot tube.

In a further aspect, the angle θ is from about 8 degrees to about 55 degrees. Alternatively, the angle θ is from about 12 degrees to about 35 degrees. Still alternatively, the angle θ is from about 18 degrees to about 25 degrees.

In a further aspect, a burner is mounted in the tubular sleeve.

In another embodiment, a burner retraction system includes a mounting assembly, an insertion assembly, a pivot rod, a pivot assembly, and a stop pin. The mounting assembly has a mounting plate and a mounting sleeve extending rearwardly from the mounting plate, the mounting sleeve having an axis. The insertion assembly has a tubular sleeve including an insertion portion sized and shaped for insertion into the mounting sleeve of the mounting assembly, the tubular sleeve including an opening therethrough. The pivot rod is rigidly mounted to and extends rearwardly from the mounting plate, the pivot rod having an axis. The pivot assembly is rigidly mounted to the tubular sleeve and includes a pivot tube surrounding and coaxially rotatable about the pivot rod, the pivot tube having a slot including a straight portion extending in the axial direction of the pivot tube, an angled portion extending rearwardly from the straight portion at an angle θ with respect to the axial direction of the pivot tube, and a stop end terminating the angled portion. The stop pin is slidably inserted through the slot in the pivot tube and secured to the pivot rod, such that when the insertion assembly is moved rearwardly with respect to the mounting assembly, the insertion portion of the insertion assembly is first retracted straight back from the mounting assembly as the stop pin slides in the straight portion of the slot, and the insertion assembly is then guided to rotate about the pivot rod away from the axis of the mounting assembly as the stop pin slides in the angled portion of the slot, until the stop end of the slot comes into contact with the stop pin.

In one aspect, the insertion assembly is a burner body and the tubular sleeve forms an outer wall of a burner. In another aspect, the insertion assembly is configured to receive and support at least a portion of a burner mounted within the tubular sleeve. In yet another aspect. the mounting assembly is a burner body and the mounting sleeve forms an outer wall of a burner, and the insertion assembly is a portion of the burner and the tubular sleeve forms an inner conduit within the burner.

In another embodiment, a burner retraction system includes a mounting assembly, an insertion assembly, a pivot rod, a pivot assembly, and a stop pin. The mounting assembly has a mounting plate and a mounting sleeve extending rearwardly from the mounting plate, the mounting sleeve having an axis. The insertion assembly has a tubular sleeve including an insertion portion sized and shaped for insertion into the mounting sleeve of the mounting assembly, the tubular sleeve including an opening therethrough. The pivot rod is rigidly mounted to and extends rearwardly from the mounting plate, the pivot rod having an axis and a slot including a straight portion extending in the axial direction of the pivot rod, an angled portion extending rearwardly from the straight portion at an angle θ with respect to the axial direction of the pivot rod, and a stop end terminating the angled portion. The pivot assembly is rigidly mounted to the tubular sleeve and includes a pivot tube surrounding and coaxially rotatable about the pivot rod. The stop pin is secured to the pivot tube and slidably inserted into the slot in the pivot rod, such that when the insertion assembly is moved rearwardly with respect to the mounting assembly, the insertion portion of the insertion assembly is first retracted straight back from the mounting assembly as the stop pin slides in the straight portion of the slot, and the insertion assembly is then guided to rotate about the pivot rod away from the axis of the mounting assembly as the stop pin slides in the angled portion of the slot, until the stop end of the slot comes into contact with the stop pin.

The various aspects of the system disclosed herein can be used alone or in combinations with each other.

DETAILED DESCRIPTION

Figure 1:
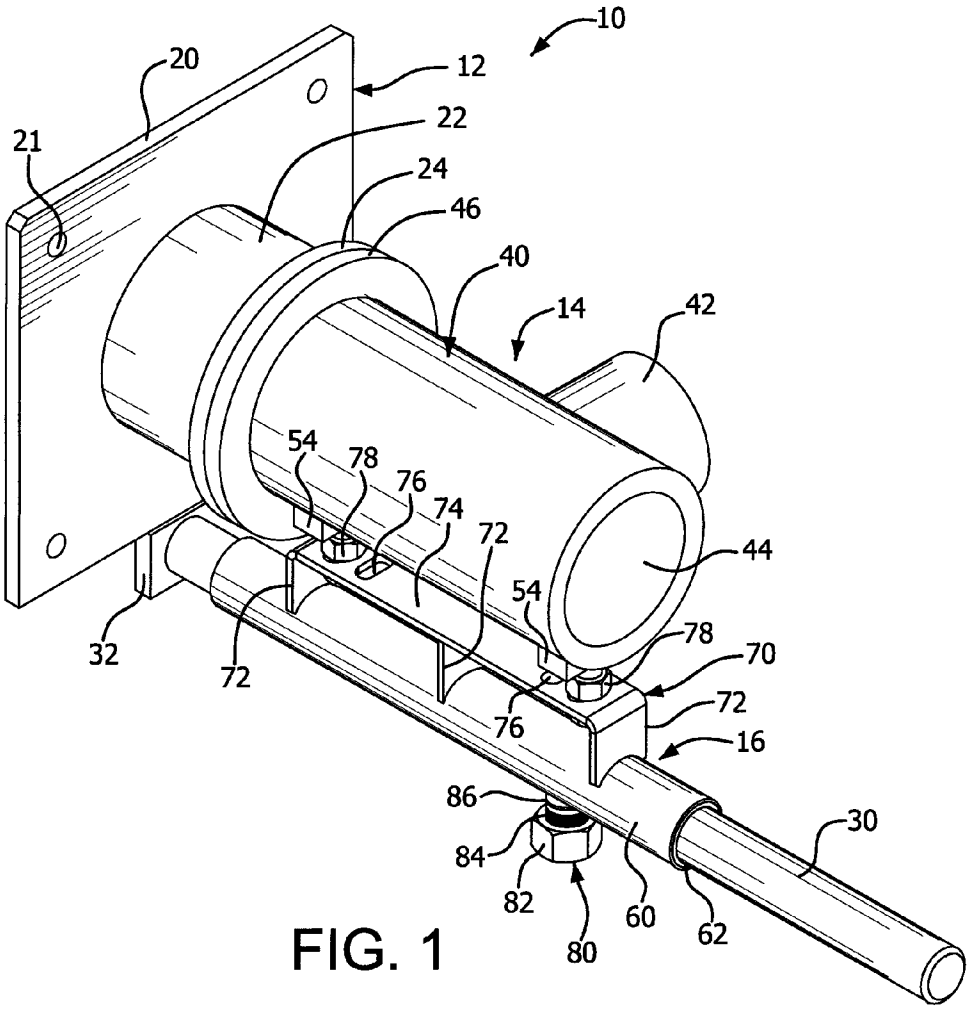
FIG. 1 is a perspective view of an embodiment of a burner retraction system.

FIG. 1 shows an embodiment of a burner retraction system 10. The system 10 includes a mounting assembly 12, an insertion assembly 14, and a pivot assembly 16.

Figure 6A:
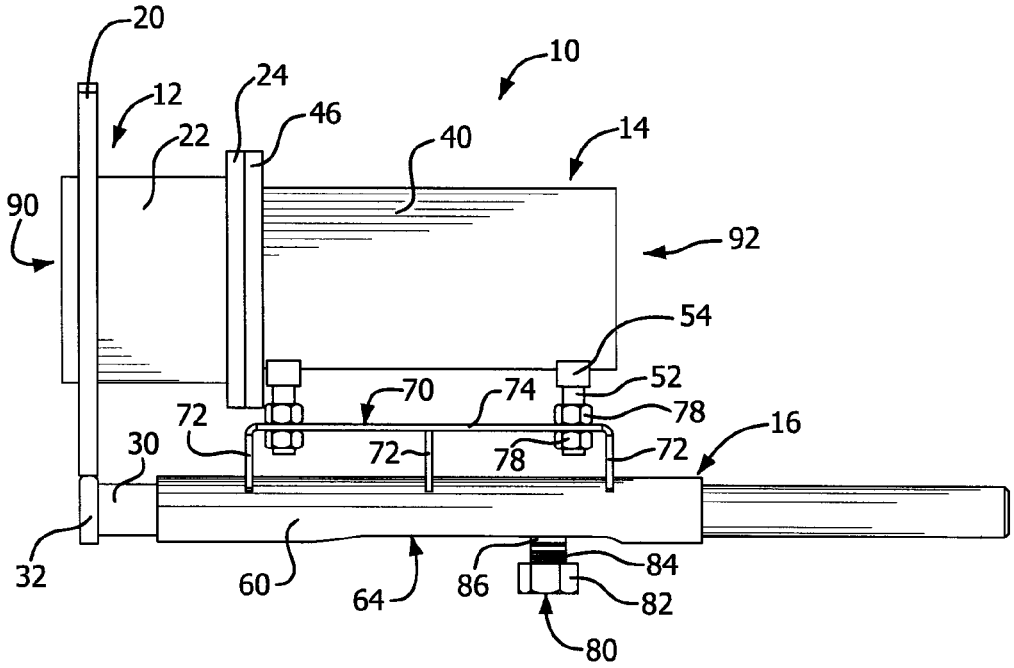
FIGS. 6A and 6B are side views of a burner in the inserted and retracted positions, respectively, implementing a burner retraction system as in FIG. 1.

The mounting assembly 12 is configured to be mounted to a furnace wall or to a burner block. In one embodiment, the mounting assembly 12 is a burner body. In another embodiment, the mounting assembly 12 is used to support a burner. The burner may be formed by the insertion assembly 14 or may be inserted into the insertion assembly 14. The mounting assembly 12 provides a stable based for the insertion assembly 14, by itself or in combination with other support mechanisms from above or below, when the insertion assembly 14 is installed into the mounting assembly 12, and during retraction of the insertion assembly 14 from the mounting assembly 12. For directional reference, a front 90 and a rear 92 of the system 10 are defined as shown in FIG. 6A.

Figure 2:
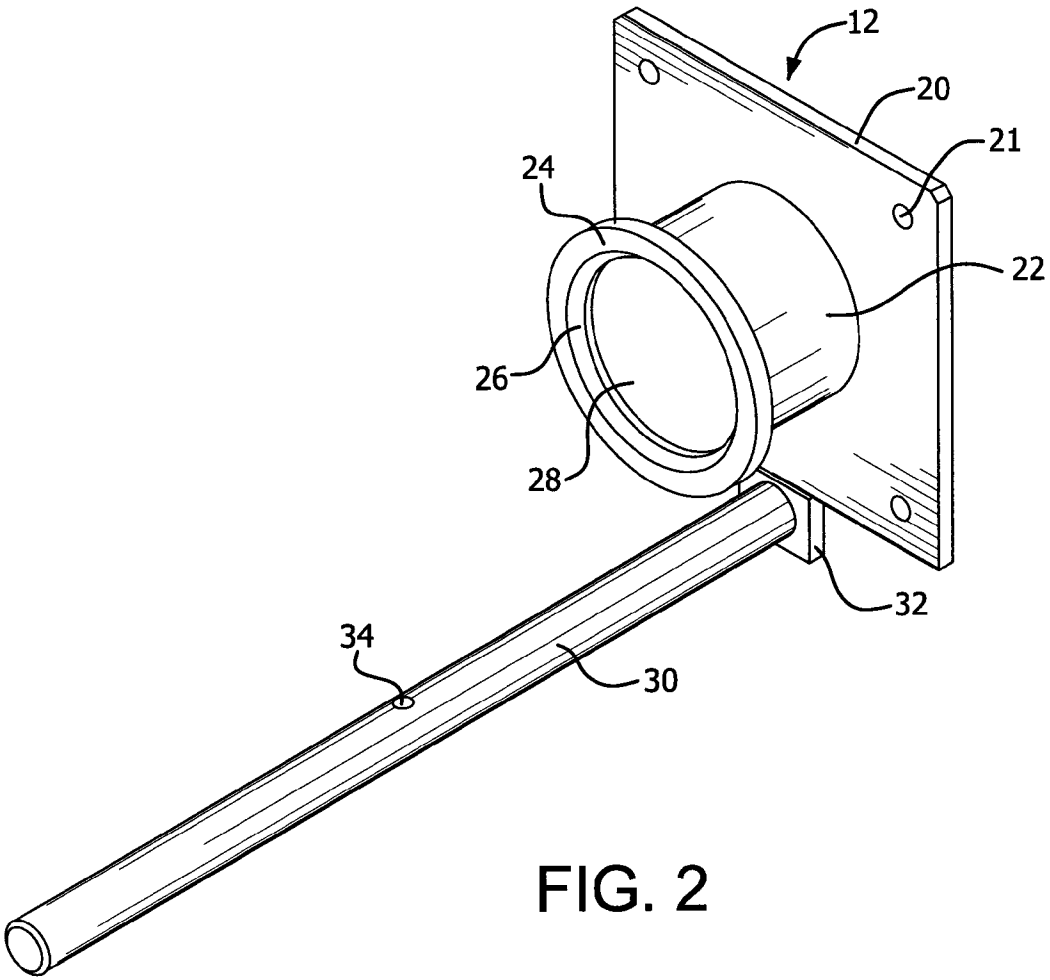
FIG. 2 is a perspective view of an embodiment of a mounting assembly for use in a burner retraction system as in FIG. 1.

As shown in FIG. 2, an embodiment of the mounting assembly 12 includes a mounting plate 20 having a front face (not shown) configured to be positioned against a furnace wall or the outer wall of a burner block, and the mounting plate 20 is configured to be mounted to the furnace wall, to a burner block, or to another fixture connected to the furnace. While the depicted embodiment includes a substantially planar mounting plate 20, the mounting plate 20 may be shaped or contoured as necessary to mate with and be generally flush against an outer wall of a furnace or a burner block. A plurality of bolt holes 21 extend through the mounting plate 20 for securely affixing the mounting assembly 12.

A tubular mounting sleeve 22 has an axis and an inner diameter opening 28. Although the tubular sleeve 22 is depicted in FIG. 2 as generally cylindrical, it is understood that the tubular sleeve 22 may be of any cross-sectional shape having a passage therethrough. For example, the tubular sleeve 22 may alternatively be generally rectangular or generally square or any other regular or irregular shape. The mounting sleeve 22 extends rearwardly from the mounting plate 20. The mounting sleeve 22 may also extend frontwardly into the furnace wall or burner block, and may, for example, form a portion of the burner or burner block. The mounting plate 20 has an opening therethrough to match the inner diameter opening 28 of the mounting sleeve 22 to enable the insertion assembly 14 or at least a portion of a burner to be inserted through the mounting sleeve 22 and the mounting plate 20 into the burner block or furnace. The mounting assembly 12 may also include a collar or flange 24 extending radially outward from a rear end of the mounting sleeve 22, as shown in FIG. 2, to provide for mating and clamping with the insertion assembly 14. Additionally, a radially inner edge of the collar 24 may include a bevel 26 to facilitate alignment of the insertion assembly 14 or a burner as it is inserted into the opening 28 in the mounting sleeve 22.

A substantially cylindrical pivot rod 30 extends rearwardly from the mounting plate 20 and has an axis substantially parallel to the axis of the mounting sleeve 22. In the depicted embodiment, the mounting plate 20 includes a mounting tab 32 that protrudes downwardly from the mounting plate, and the mounting tab 32 supports the pivot rod 30. The mounting tab 32 may be integrally formed with the mounting plate 20, or the mounting tab 32 may be welded or bolted or otherwise affixed to the mounting plate 20. Alternatively, the mounting plate 20 may extend sufficiently from the mounting sleeve 22 so as to support the pivot rod 30 without a separate mounting tab 32.

The pivot rod 30 may be a solid substantially cylindrical rod, or the pivot rod 30 may be a hollow substantially cylindrical tube. In one embodiment, as shown, the pivot rod 30 includes a threaded hole 34, which may be a blind hole or a through hole, extending radially inward from a sidewall of the pivot rod 30.

Figure 3:
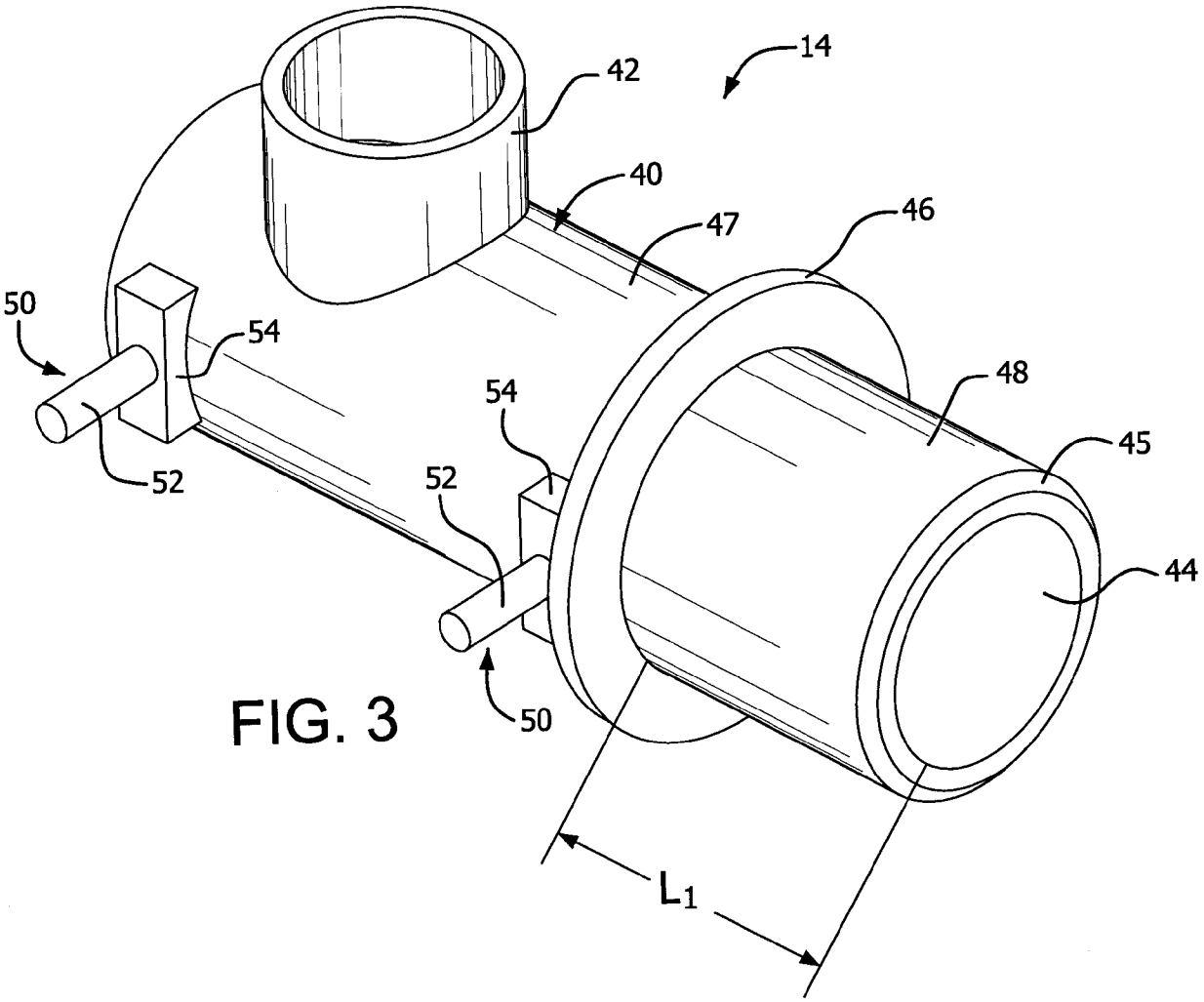
FIG. 3 is a perspective view of an embodiment of a support assembly for use in a burner retraction system as in FIG. 1.

As shown in FIG. 3, an embodiment of the insertion assembly 14 includes a generally cylindrical or tubular sleeve 40 having an axis. The tubular sleeve 40 includes an insertion sleeve portion 48 and an external sleeve portion 47. The insertion portion 48 is sized and shaped to fit closely within the opening 28 in the mounting sleeve 22, while the external portion 47 remains rearward of the mounting sleeve 22, when the insertion assembly 14 is installed into the mounting assembly 12. In one embodiment, the insertion assembly 14 is a burner body and the tubular sleeve 40 forms an outer wall of a burner. In another embodiment, the insertion assembly 14 is configured to receive and support a burner mounted within the tubular sleeve 40.

The insertion portion 48 has an insertion length L1. The insertion assembly 14 may also include a collar or flange 46 extending radially outward from the tubular sleeve 40 at the junction of the insertion sleeve portion 48 and the external sleeve portion 47. A front end of the insertion sleeve portion 48 may include a bevel 45 to facilitate insertion of the insertion portion 48 of the tubular sleeve 40 into the opening 28 of the mounting sleeve 22.

The flange 46 is configured to mate with the flange 24 of the mounting sleeve 22 when the burner is inserted into the furnace. In one embodiment, the flanges 24 and 46 may be clamped together by a clamp or other mechanism (not shown) to secure the insertion assembly 14 to the mounting assembly 12 when the burner is installed in the furnace. A gasket or other sealing member (not shown) may be positioned between the flange 24 and the flange 46 to provide a seal.

The tubular sleeve 40 has an inner diameter opening 44. As described above, the opening 44 may form a conduit of a burner, or may be configured to receive and support a burner inserted thereinto.

Figure 9:
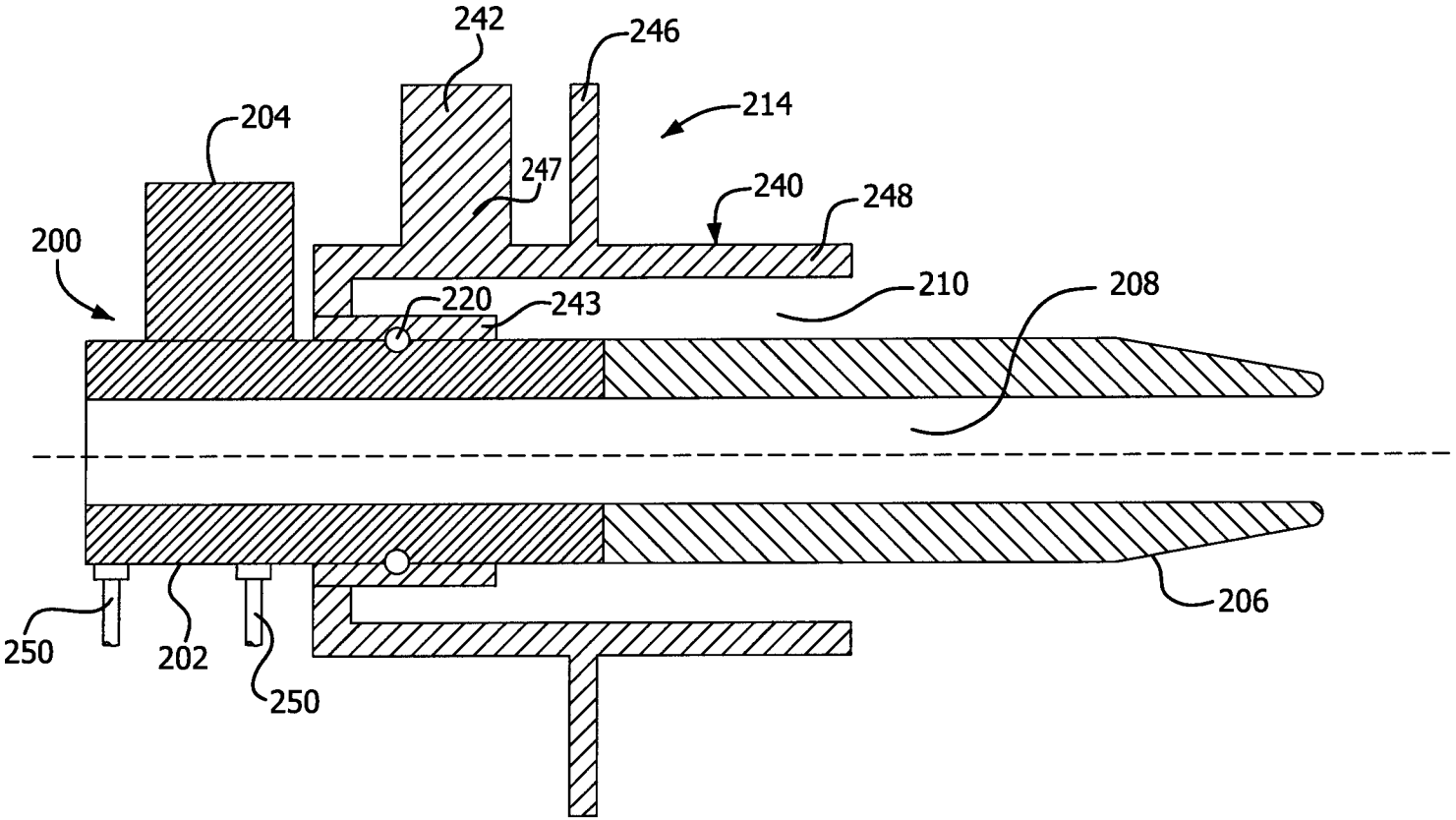
FIG. 9 is a side cross-sectional view of an embodiment of a burner mounted in a support assembly as in FIG. 3.

Alternatively, as shown in FIG. 9, the tubular sleeve 40 forms the outer conduit of a burner, and an additional portion 200 of the burner is installed into the opening 244. The burner portion 200 can be retractable by the same system 10 as described herein. The burner includes a central conduit 202, a first gas inlet 204, and a nozzle 206 at the front end of the central conduit 202. Support members 250 are attached to the central conduit 202, and the support members 250 are rigidly affixed to a pivot tube 60 as described above. In the depicted embodiment, the tubular sleeve 40 includes a smaller diameter sealing sleeve 243 at its rear end for sealing against an outer wall of the central conduit 202. An o-ring 220 or other removable sealing mechanism may be provided for sealing purposes. A second gas inlet port 242 is provided in the tubular sleeve 240, and an annular passage is formed between the inner wall of the tubular sleeve 240 and the outer walls of the central conduit 202 and nozzle 206.

In one embodiment of the configuration of FIG. 9, oxidant is provided to the first gas inlet 204 and fuel is provided to the second gas inlet 242. In another embodiment, fuel is provided to the first gas inlet 204 and oxidant is provided to the second gas inlet 242. Flexible piping to the burner connects to the first gas inlet 204 and, and optionally to the second gas inlet 242, so that the burner can be retracted and installed unimpeded by rigid piping.

A pair of support members 50 extends radially outward from an outer wall of the external sleeve portion 47. In one embodiment, the support members 50 are aligned with each other parallel to the axis of the tubular sleeve 40. In the depicted embodiment, each support member 50 includes a support block 54 affixed to the external sleeve portion 47 and a support rod 52 extending radially outward from the support block 54. However, it is understood that various alternative support member configurations could be substituted by a person of ordinary skill in the art. In the depicted embodiment, the support rods 52 are externally threaded.

Figure 4A:
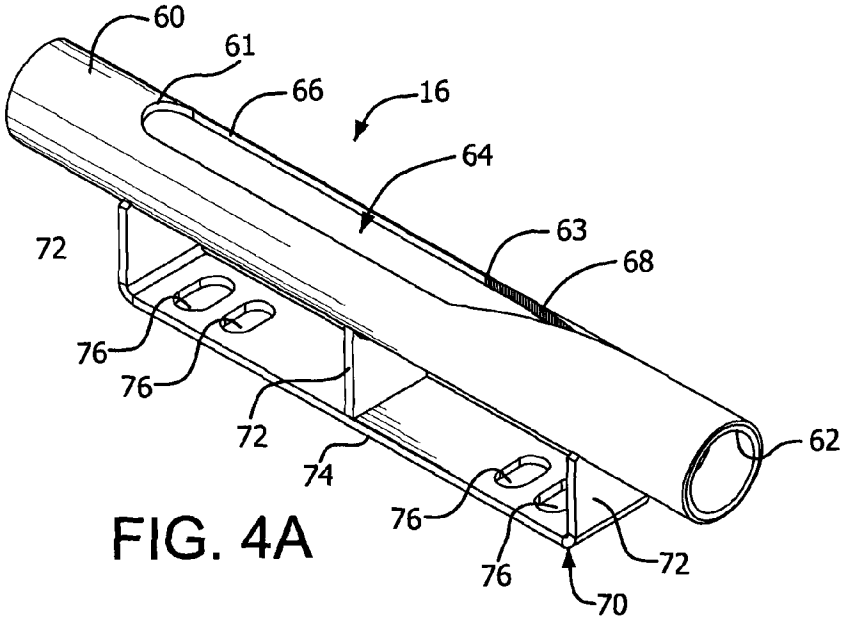
FIG. 4A is a perspective view of an embodiment of a pivot assembly for supporting a support assembly as in FIG. 3 from a mounting assembly as in FIG. 2.
Figure 4B:
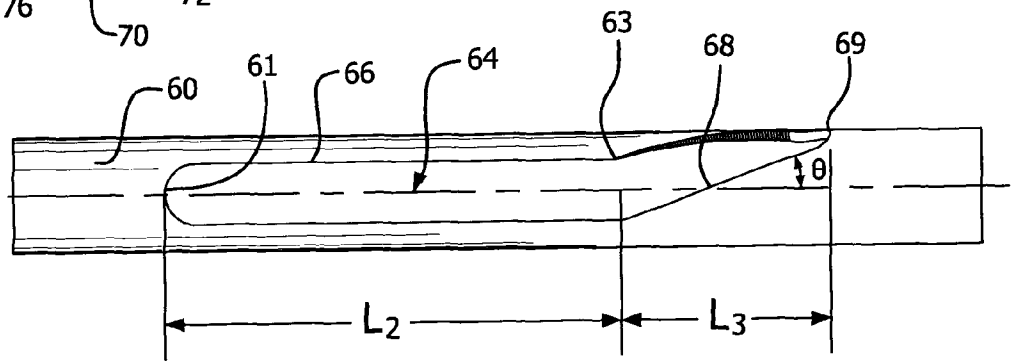
FIG. 4B is a top view of the pivot assembly of FIG. 4A.

The pivot assembly 16 forms a translatable and pivotable connection between the fixed mounting assembly 12 (when secured to the furnace) and the insertion assembly 14 which is movable with respect to the mounting assembly 12. As shown in FIGS. 4A and 4B, the pivot assembly 16 includes a pivot tube 60 rigidly affixed to a support bracket 70.

The pivot tube 60 is a substantially cylindrical hollow tube configured to be slidable and rotatable with respect to the pivot rod 30. Specifically, the pivot tube 60 has an inner diameter than is somewhat larger than the outer diameter of the pivot rod 30. In one embodiment, the inner diameter of the pivot tube 60 tube is slightly larger than outer diameter of the pivot rod 30, and the tube 60 and the rod 30 interface directly. In another embodiment, two or more sleeve bushings 62 are positioned (for example, one bushing 62 at or near each end of the pivot tube 60) to bridge the gap between the pivot rod outer wall and the pivot tube inner wall. The bushings 62 may be, for example, made from a graphite impregnated brass or other similar material. The criteria for sizing and fitting such bushings 62 is known.

The support bracket 70 may be of any construction that enables the pivot tube 60 to be rigidly mounted to the insertion assembly 14. In the depicted embodiment, the support bracket 70 includes a support bar 74 extending substantially parallel to the axis of the pivot tube 60 and support legs 72. Each support leg 72 extends from the support bar 74 to the pivot tube 60, where the support legs 72 are each affixed to the pivot tube 60, for example by welding. Although three support legs 72 are shown, it is understood that any number of support legs 72 can be used as necessary. The support bar 74 includes a plurality of slotted holes 76 for receiving the support rods 52 from the insertion assembly 14. Multiple slotted holes 76 may be provided to accommodate various sizes of support assemblies 14, and thus various sizes of burners. Nuts 78 may be used to secure the threaded support rods 52 in the slots 76, thereby rigidly mounting the insertion assembly 14 to the support bracket 70 of the pivot assembly 16.

The pivot tube 60 includes a slot 64 therethrough, the slot including a straight portion 66 extending parallel to the axis of the pivot tube 60 adjoined to an angled portion 68 extending rearwardly and radially around a portion of the pivot tube 60. The straight portion 66 terminates at an end 61 and is adjoined to the angled portion 68 at a junction 63. The angled portion 68 terminates at a stop end 69. The straight portion 66 has a retraction length L2 that is greater than the insertion length L1 of the insertion sleeve portion 48 of the tubular sleeve 40. The angled portion 68 of the slot 64 has an axial length L3. When combined, the axial length L2 and the axial length L3 enable the insertion assembly 14 to move at least a distance X (shown in FIG. 6B) between a fully inserted position and a fully retracted position with respect to the mounting assembly 12.

The angled portion 68 of the slot 64 angles away from the straight portion 66 at an angle θ that is sufficiently large to rotate the insertion assembly 14 away from the axis of the mounting assembly 12 in a reasonable retraction distance and sufficiently small so as to brace the weight of the insertion assembly 14, and in some cases including at least a portion of the burner, as it are pivoted about the pivot rod 30. For most cases, a suitable angle θ can be found in the range of 8° to about 55° as measured between the axes of the straight portion 66 and the angled portion 68, preferably between about 12° and about 35°, and more preferably between about 18° and about 25°. Embodiments having angles θ of 21° and 25° have been fabricated and tested.

Figure 5:
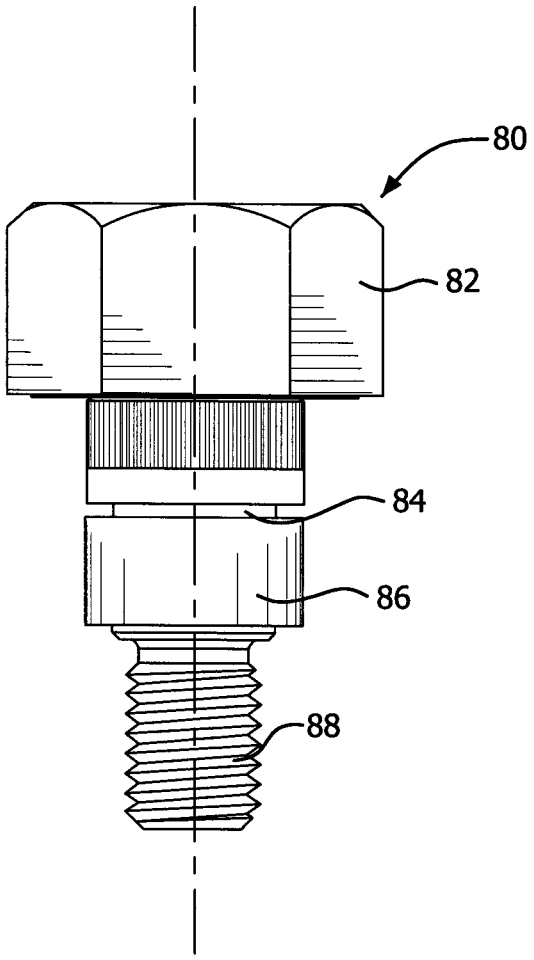
FIG. 5 is a side view of an embodiment of a stop pin for use in a burner retraction system as in FIG. 1.

A stop pin 80 operably interconnects the pivot tube 60 and the pivot rod 30. As shown in the exemplary embodiment of FIG. 5, the stop pin 80 includes a shank 84 extending axially from a head 82, the shank having a bushing portion 86 proximate to the head 82 and a treaded tip portion 88 distal from the head 82. The bushing portion 86 may include a sleeve bushing fitted over the shank 84.

When the pivot tube 60 is positioned over (i.e., surrounding) the pivot rod 30 and a portion of the slot 64 in the pivot tube 60 is aligned with the stop hole 34 of the pivot rod 30, the stop pin 80 is inserted through the slot 64 and threaded into the stop hole 34 so that the bushing portion 84 sits within the slot 64. Thus, the stop pin 80 may be removed to enable disassembly of the pivot tube 60 from the pivot rod 30. The outer diameter of the bushing portion 84 is sized large enough to fit snugly in the slot 64 to small enough to slide smoothly when the pivot tube 60 is moved relative to the pivot rod 30.

When the retraction system 10 is fully assembled, the stop pin 80 guides the movement of the insertion assembly 14 with respect to the mounting assembly 12, as shown in FIGS. 6A-6B and 7A-7B. When the insertion sleeve portion 48 of the tubular sleeve 40 is fully inserted into the opening 28 of the mouthing sleeve 22 such that the collars 24 and 46 be adjacent to each other, the pivot tube 60 is positioned on the pivot rod 30 such that the stop pin 80 is located at or near the end 61 of the straight portion 66 of the slot 64.

As the insertion assembly 14 is retracted from the mounting assembly 12 such that the insertion sleeve portion 48 slides rearward from the opening 28 in the mounting sleeve 22, the stop pin 80 slides along the straight portion 66 of the slot 64 in the pivot tube 60 until the insertion portion 48 is fully retracted from the mounting sleeve 22. Once the tubular sleeve 40 is clear of the mounting assembly 12, as the insertion assembly 14 is further retracted, the stop pin 80 slides across the junction 63 and into the angled portion 68 of the slot 64, causing the insertion assembly 14 to begin to pivot away from the axis of the mounting assembly 12 as the pivot tube 60 rotates about the pivot rod 30.

The speed of rotation is controlled by the angle θ of the angled portion 68 of the slot 64 so that the cantilevered weight of the insertion assembly 14, and burner if present or if the insertion assembly 14 forms part of the burner, is braced by the contact of the stop pin 80 with the angled portion 68 of the slot 64. The controlled retraction and rotation of the insertion assembly 14 continues until the stop pin 80 comes into contact with the stop end 69 of the slot 64 and the insertion assembly 14 has been pivoted out from behind the mounting sleeve 22 of the mounting assembly 12. At this point, the weight of the insertion assembly 14, and the burner if present or incorporated into the insertion assembly, is support by the stop pin 80 contacting the stop end 69 of the slot 64, which prevents any further rotation of the pivot tube 60 with respect to the pivot rod 30.

Figure 6B:
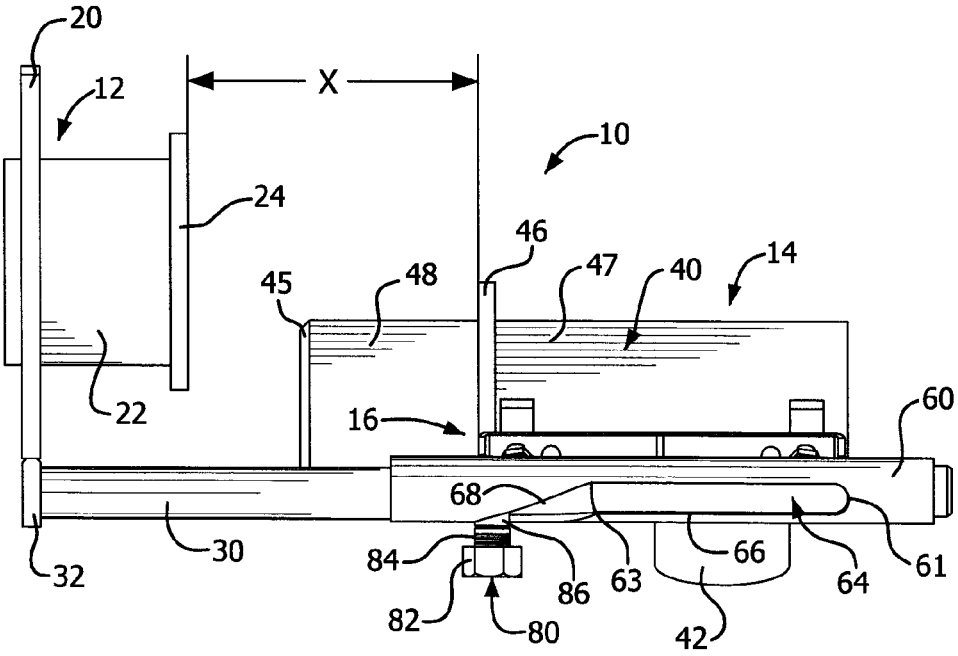
Figure 7A:
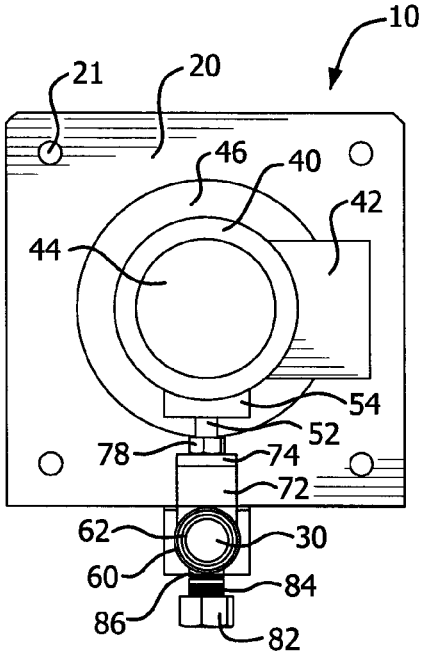
FIGS. 7A and 7B are rear end views of a burner in the inserted and retracted positions, respectively, implementing a burner retraction system as in FIG. 1, FIG. 7A corresponding to FIG. 6A and FIG. 7B corresponding to FIG. 6B.
Figure 7B:
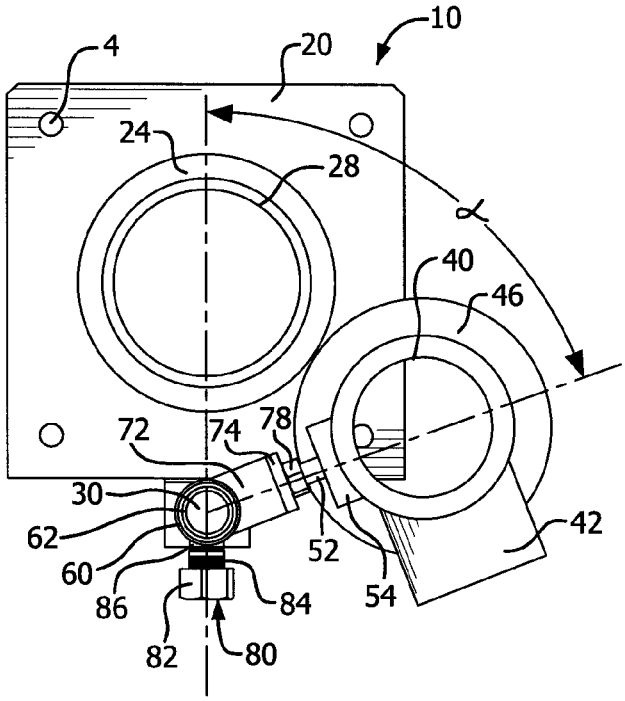

As shown in FIG. 6B, the total retraction distance X can be adjusted if necessary by increasing the angle θ between the straight portion 66 and the angled portion 68 of the slot 64. When fully retracted, the insertion assembly 14 pivots by an angle α from the axis of the mounting assembly 12. The angle α can be adjusted depending on the application and the particular furnace and mounting configuration. For example, it may not always be necessary for the insertion assembly 14 to completely clear the region rearward of the mounting sleeve 22.

Installation of the insertion assembly 14, and a burner if inserted thereinto, is simply the reverse of retraction. From the fully retracted rest position in which the stop pin 80 is in contact with the stop end 69, the insertion assembly 14 is pivoted upward toward the axis of the mounting assembly 12 while being moved forward, as the stop pin 80 slides in the angled portion 68 of the slot 64. Once the stop pin 80 passes the junction 63, the axis of the insertion assembly 14 is substantially aligned with the axis of the mounting assembly 12, so that as the insertion assembly 14 is further moved frontward and the stop pin slides in the straight portion 66 of the slot 64, the insertion portion 48 of the tubular sleeve 40 is positioned for insertion into the opening 28 of the mounting sleeve 22. The bevel 45 on the tubular sleeve 40 and the bevel 26 on the mounting sleeve 22 help guide the insertion portion 48 into the opening 28. Finally, the collars 24 and 46 come into contact, prior to the stop pin 80 reaching the end 61 of the straight portion 66 of the slot 64, and the insertion assembly 14 can be secured in place with respect to the mounting assembly 12 by securing the collars 24 and 46 to each other.

Figure 8:
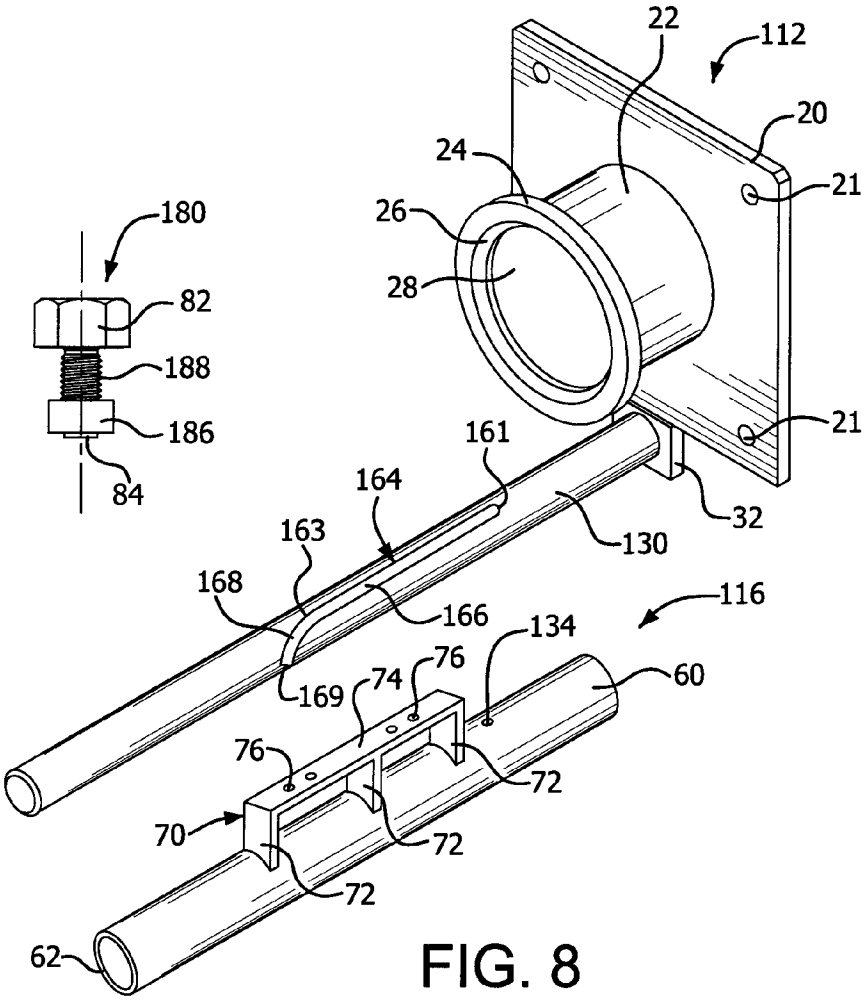
FIG. 8 is a perspective view of another embodiment of a mounting assembly with a pivot tube for use in a burner retraction system as in FIG. 1.

An alternative embodiment of the mounting assembly 112, pivot assembly 116, and stop pin 180 is shown in FIG. 8. In the depicted embodiment, a pivot rod 130 includes slot 164 having a straight portion 166 extending parallel to the axis of the pivot rod 130 adjoined to an angled portion 168 extending rearwardly and radially around a portion of the pivot rod 130. The straight portion 166 terminates at an end 161 and is adjoined to the angled portion 168 at a junction 163. The angled portion 168 terminates at a stop end 169. The angled portion 168 of the slot 164 angles away from the straight portion 166 at an angle θ. The pivot tube 160 includes an internally threaded stop hole 134 for receiving a stop pin 180. The stop pin 180 includes a shank 184 extending axially from a head 182, the shank having a bushing tip portion 186 distal from the head 82 and a treaded portion 188 proximate the head 82. The bushing portion 186 may include a sleeve bushing fitted over the shank 84.

It is understood that in either embodiment, the relative movement of the insertion assembly 14 with respect to the mounting assembly 12 or 112 can be actuated manually or by an automated mechanism, for example a mechanism tied into the furnace process controls.

Alternate embodiments of a burner retraction system can be made to enable a burner to be retracted first in an axial direction from the burner block and/or furnace and then in a lateral direction out of the line installation of the burner. In one such embodiment, the system includes a guide assembly that serves a similar function as the pivot tube 60 in the system 10 discussed above. Specifically, the guide assembly includes a plate having a pair of slots, each slot having an axial portion oriented substantially parallel to the axis of the tubular sleeve 40 and a lateral portion oriented at an angle with respect to the axial portion.

The present invention is not to be limited in scope by the specific aspects or embodiments disclosed in the examples which are intended as illustrations of a few aspects of the invention and any embodiments that are functionally equivalent are within the scope of this invention. Various modifications of the invention in addition to those shown and described herein will become apparent to those skilled in the art and are intended to fall within the scope of the appended claims.

The invention claimed is:

1. A burner retraction system, comprising:

a mounting assembly having a mounting plate and a mounting sleeve extending rearwardly from the mounting plate, the mounting sleeve having an axis;

an insertion assembly having a tubular sleeve including an insertion portion sized and shaped for insertion into the mounting sleeve of the mounting assembly, the tubular sleeve including an opening therethrough;

a pivot rod rigidly mounted to and extending rearwardly from the mounting plate, the pivot rod having an axis, and a pivot assembly rigidly mounted to the insertion sleeve and including a pivot tube surrounding and coaxially rotatable about the pivot rod, one of the pivot rod and the pivot tube having a slot including a straight portion extending in the axial direction of the pivot tube, an angled portion extending rearwardly from the straight portion at an angle θ with respect to the axial direction of the pivot tube, and a stop end terminating the angled portion; and a stop pin slidably inserted into the slot in the one of the pivot rod and the pivot tube, the stop pin being secured to the other of the pivot rod and the pivot tube, such that when the insertion assembly is moved rearwardly with respect to the mounting assembly, the insertion portion of the insertion assembly is first retracted straight back from the mounting assembly as the stop pin slides in the straight portion of the slot, and the insertion assembly is then guided to rotate about the pivot rod away from the axis of the mounting assembly as the stop pin slides in the angled portion of the slot, until the stop end of the slot comes into contact with the stop pin; wherein the insertion assembly is a burner body and the tubular sleeve forms an outer wall of a burner.

2. The burner retraction system of claim 1, wherein the pivot tube includes the slot and the stop pin is secured to the pivot rod.

3. The burner retraction system of claim 1, wherein the pivot rod includes the slot and the stop pin is secured to the pivot tube.

4. The burner retraction system of any one of claims 1 to 3, wherein the insertion assembly is configured to receive and support at least a portion of a burner mounted within the tubular sleeve.

5. The burner retraction system of any one of claims 1 to 3, wherein the mounting assembly is a burner body and the mounting sleeve forms an outer wall of a burner, and wherein the insertion assembly is a portion of the burner and the tubular sleeve forms an inner conduit within the burner.

6. The burner retraction system of claim 1, the mounting assembly further including a collar protruding radially outward from a rear end of the mounting sleeve; and the insertion assembly further including an external portion of the support sleeve extending rearwardly from the insertion portion of the tubular sleeve and a collar protruding radially outward from the tubular sleeve at a junction between the insertion portion and the external portion;

wherein the mounting assembly collar and the insertion assembly collar are configured to be adjacent to one another when the insertion portion of the tubular sleeve is fully inserted into the mounting sleeve.

7. The burner retraction system of claim 1, the pivot assembly further comprising a mounting bracket rigidly affixed to the pivot tube and removably mounted to the tubular sleeve.

8. The burner retraction system of any one of the preceding claim 1, wherein the mounting sleeve includes an inner bevel and the insertion portion of the tubular sleeve includes an outer bevel to facilitate alignment of the tubular sleeve with the mounting sleeve during insertion of the insertion portion into the mounting sleeve.

9. The burner retraction system of claim 1, further comprising an annular bushing positioned between the pivot rod and the pivot tube at each end of the pivot tube.

10. The burner retraction system of any one of the preceding claim 1, further comprising an annular bushing surrounding the stop pin to facilitate sliding of the stop pin with the slot of the pivot tube.

11. The burner retraction system of claim 1, wherein the angle θ is from about 8 degrees to about 55 degrees.

12. The burner retraction system of claim 11, wherein the angle θ is from about 12 degrees to about 35 degrees.

13. The burner retraction system of claim 12, wherein the angle θ is from about 18 degrees to about 25 degrees.

14. The burner retraction system of claim 1, further comprising a burner mounted in the tubular sleeve.

15. A burner retraction system, comprising:

a mounting assembly having a mountain plate and a mounting sleeve extending rearwardly from the mounting plate, the mounting sleeve having an axis;

an insertion assembly having a tubular sleeve including an insertion portion sized and shaped for insertion into the mounting sleeve of the mounting assembly, the tubular sleeve including an opening therethrough;

a pivot rod rigidly mounted to and extending rearwardly from the mounting plate, the pivot rod having an axis;

a pivot assembly rigidly mounted to the tubular sleeve and including a pivot tube surrounding and coaxially rotatable about the pivot rod, the pivot tube having a slot including a straight portion extending in the axial direction of the pivot tube, an angled portion extending rearwardly from the straight portion at an angle θ with respect to the axial direction of the pivot tube, and a stop end terminating the angled portion; and a stop pin slidably inserted through the slot in the pivot tube and secured to the pivot rod, such that when the insertion assembly is moved rearwardly with respect to the mounting assembly, the insertion portion of the insertion assembly is first retracted straight back from the mounting assembly as the stop pin slides in the straight portion of the slot, and the insertion assembly is than guided to rotate about the pivot rod away from the axis of the mountain assembly as the stop pin slides in the angled portion of the slot, until the stop end of the slot comes into contact with the stop pin; wherein the insertion assembly is a burner body and the tubular sleeve forms an outer wall of a burner.

16. The burner retraction system of claim 15, wherein the insertion assembly is configured to receive and support at least a portion of a burner mounted within the tubular sleeve.

17. The burner retraction system of claim 15, wherein the mounting assembly is a burner body and the mounting sleeve forms an outer wall of a burner, and wherein the insertion assembly is a portion of the burner and the tubular sleeve forms an inner conduit within the burner.

18. A burner retraction system, comprising:

a mounting assembly having a mounting plate and a mounting sleeve extending rearwardly from the mounting plate, the mounting sleeve having an axis;

an insertion assembly having a tubular sleeve including an insertion portion sized and shaped for insertion into the mounting sleeve of the mounting assembly, the tubular sleeve including an opening therethrough;

a pivot rod rigidly mounted to and extending rearwardly from the mounting plate, the pivot rod having an axis and a slot including a straight portion extending in the axial direction of the pivot rod, an angled portion extending rearwardly from the straight portion at an angle θ with respect to the axial direction of the pivot rod, and a stop end terminating the angled portion;

a pivot assembly rigidly mounted to the tubular sleeve and including a pivot tube surrounding and coaxially rotatable about the pivot rod; and a stop pin secured to the pivot tube and slidably inserted into the slot in the pivot rod, such that when the insertion assembly is moved rearwardly with respect to the mounting assembly, the insertion portion of the insertion assembly is first retracted straight back from the mounting assembly as the stop pin slides in the straight portion of the slot, and the insertion assembly is then guided to rotate about the pivot rod away from the axis of the mounting assembly as the stop pin slides in the angled portion of the slot, until the stop end of the slot comes into contact with the stop pin; wherein the insertion assembly is a burner body and the tubular sleeve forms an outer wail of a burner.

* * * * *